US007562725B1

(12) United States Patent
Broussard et al.

(10) Patent No.: US 7,562,725 B1
(45) Date of Patent: Jul. 21, 2009

(54) DOWNHOLE PILOT BIT AND REAMER WITH MAXIMIZED MUD MOTOR DIMENSIONS

(76) Inventors: Edwin J. Broussard, 3719 Darnall Rd., New Iberia, LA (US) 70560; Herman J. Schellstede, 109 Bridge St., New Iberia, LA (US) 70563

( * ) Notice: Subject to any disclaimer, the term of this patent is extended or adjusted under 35 U.S.C. 154(b) by 617 days.

(21) Appl. No.: 10/887,980

(22) Filed: Jul. 9, 2004

Related U.S. Application Data

(60) Provisional application No. 60/486,523, filed on Jul. 10, 2003.

(51) Int. Cl.
*E21B 10/02* (2006.01)
*E21B 10/26* (2006.01)

(52) U.S. Cl. ..... 175/93; 175/107; 175/324; 175/385

(58) Field of Classification Search ..... 175/93, 175/107, 385, 398, 406, 73, 391, 324
See application file for complete search history.

(56) References Cited

U.S. PATENT DOCUMENTS 3,159,224 A * 12/1964 Cleary ..... 175/391
3,882,946 A * 5/1975 Ioannesian et al. ..... 175/107
4,682,660 A * 7/1987 Barthelemy et al. ..... 175/391
4,775,017 A * 10/1988 Forrest et al. ..... 175/107
4,862,974 A * 9/1989 Warren et al. ..... 175/107
4,969,528 A * 11/1990 Jurgens ..... 175/107
5,957,223 A * 9/1999 Doster et al. ..... 175/385
6,116,356 A * 9/2000 Doster et al. ..... 175/385
6,340,064 B2 * 1/2002 Fielder et al. ..... 175/385
6,474,425 B1 * 11/2002 Truax et al. ..... 175/398
6,488,103 B1 * 12/2002 Dennis et al. ..... 175/385
7,108,080 B2 * 9/2006 Tessari et al. ..... 175/324
7,213,643 B2 * 5/2007 Chen et al. ..... 175/73

* cited by examiner

*Primary Examiner*—Richard E Chilcot, Jr.
*Assistant Examiner*—Matthew J Smith
(74) *Attorney, Agent, or Firm*—Roy, Kiesel, Keegan and DeNicola

(57) ABSTRACT

A drilling unit containing a combined pilot bit and reamer. The drilling unit includes a housing containing a mud motor and a pilot bit extending from its distal end. A reamer is mounted to the housing. The mud motor turns the pilot bit while the reamer is turned either by the mud motor or as the drill string is rotated from the surface. The well bore is drilled and reamed in one pass.

By positioning the reamer between the pilot bit and the mud motor, the mud motor must only pass through the larger reamer bore rather than the smaller pilot hole. This will allow larger mud motors to be used than would otherwise be possible.

In one embodiment, the pilot bit is offset relative to the center of the end of the drill housing, providing increased tangential speed at the point of impact between the pilot bit and formation.

17 Claims, 13 Drawing Sheets

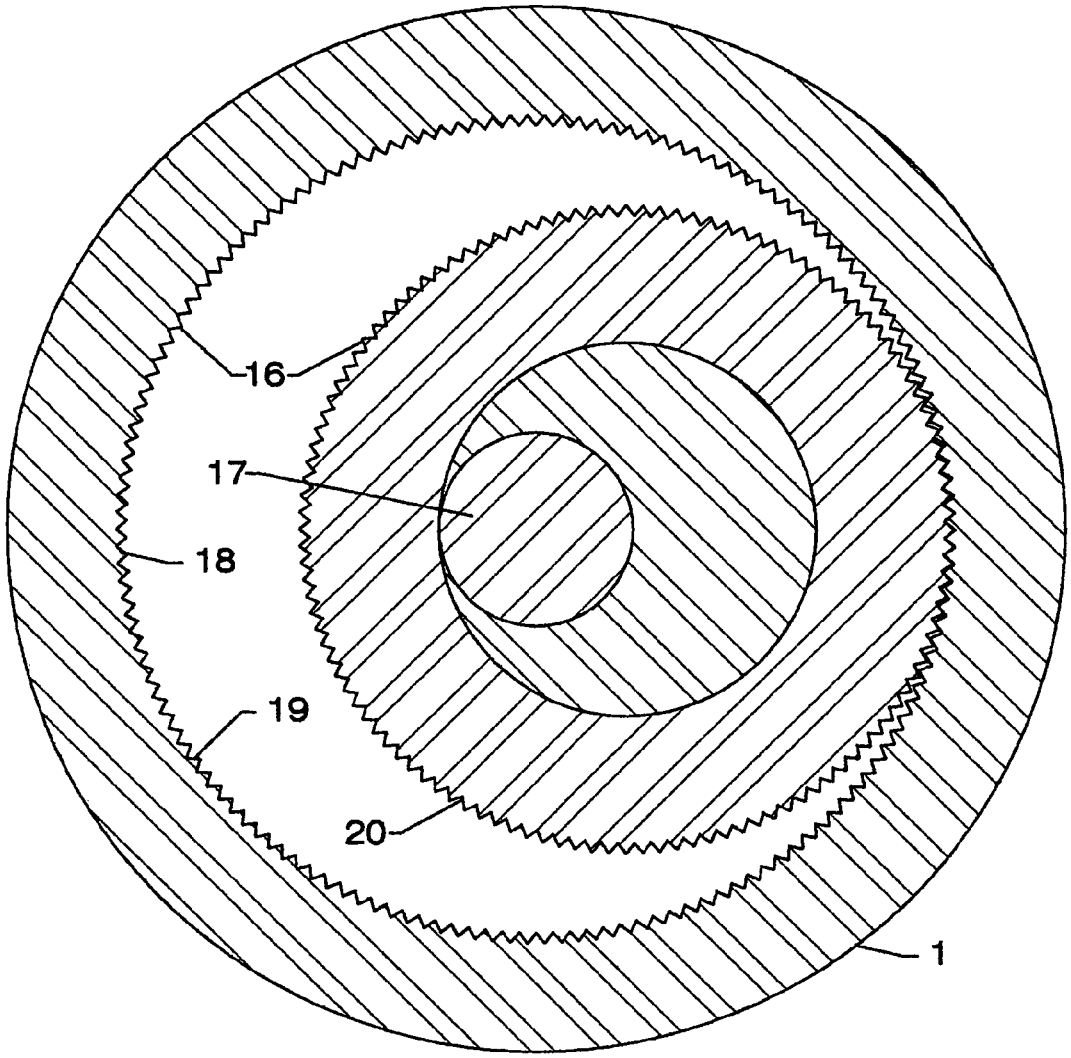
Figure 8-A

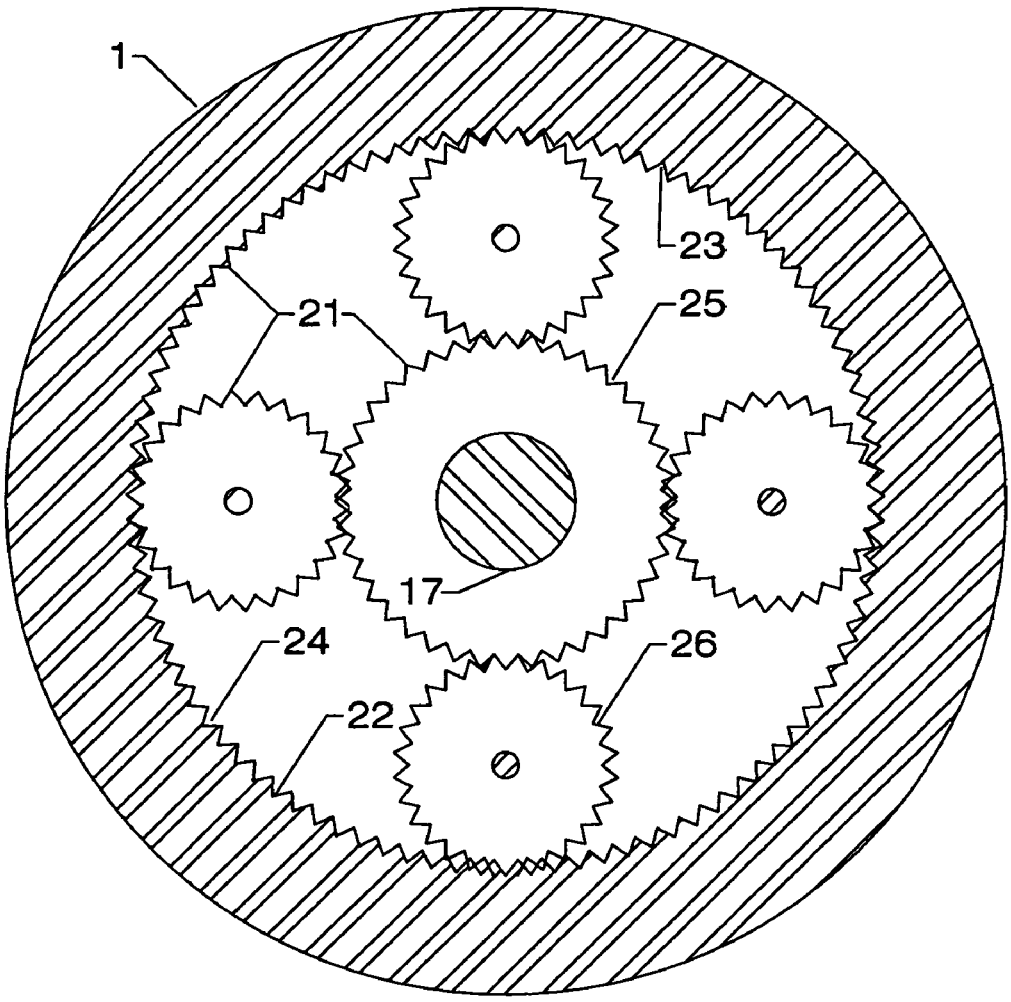
Figure 8-B

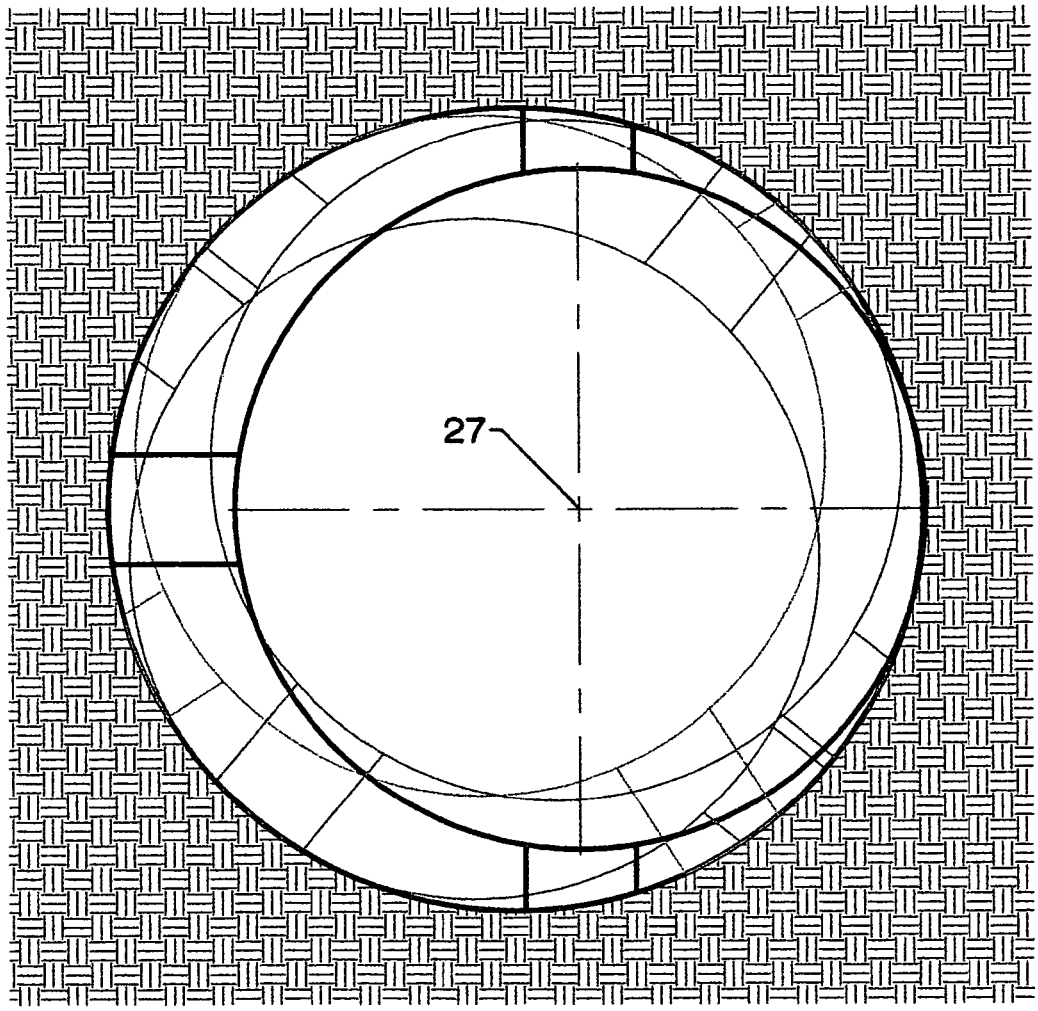
Figure 9-A

DOWNHOLE PILOT BIT AND REAMER WITH MAXIMIZED MUD MOTOR DIMENSIONS

CLAIM TO BENEFIT OF PROVISIONAL APPLICATION

This application claims benefit of provisional application No. 60/486,523 which was filed on Jul. 10, 2003, and is hereby incorporated by reference in its entirety.

BACKGROUND OF THE INVENTION

1. Field of the Invention

The invention relates to drilling bits in general and to combined pilot and reamer bits, in particular.

2. Prior Art

Torque is imparted to drill bits in one of two primary means. First, the entire drill string is turned from the surface. Second, "mud motors" (impeller driven shafts) are installed in the drill string near the bit. Drilling "mud" is pumped through the drill string, through the impeller, and out apertures on or near the pilot bit. The mud passing through the impeller turns the impeller which then turns the bit.

The drilling mud serves several other purposes as well. Once the mud flows out of the drill string near the bit, it is pumped back to the surface of the well. As it is flowing through the well bore, it serves to support the bore and hold back fluid from the surrounding formation. The mud also lubricates the bit or bits and entrains cuttings from the bit into the mud stream, carrying the cuttings back to the surface of the well.

Although the downhole mud motors are used to generate torque, higher torque can generally be imparted by turning the bit from the surface. Although torque from mud motors may be increased by linking mud motors in series, the torque which may be imparted at the surface is still generally greater. However, surface imparted torque has its limits. Too much torque and—rather than turning the bit—the drill string itself will twist in two.

Prior art drill systems are known to contain at least two types of drills: pilot drill bits and reamers. Pilot drill bits are located at the terminal end of the well bore. Reamers are generally located up string from the pilot drill bit. The pilot drill bit creates an initial well bore or "pilot hole." A reamer increases the diameter of the bore.

One current reamer is known as a "bi-center bit." Where a conventional reamer is a symmetrical pair or set of blades extending from a housing, the blade or blades of a bi-center bit extend only (or primarily) on one side of the housing. As the housing turns, the bi-center bit reams out the bore wall surrounding the housing. It can be seen that a bi-center bit with one four inch long reamer blade will increase the circumference of a well bore the same amount as a conventional symmetrical reamer with two oppositely aligned four inch long reamer blades; however the diameter of the bi-center bit will be four inches narrower than that of the conventional symmetrical bit. Thus, the bi-center bit will be able to fit down smaller casings than a conventional symmetrical reamer.

The pilot bit is often the limiting step in drilling. For example, in one recent drilling run, a 6½ inch diameter hole was drilled over a length of about 1400 feet using a polycrystalline diamond compact (PDC) pilot bit. The average rate of penetration (ROP) was about 23 feet per hour. After the pilot hole was drilled, the drill string was removed and the hole was reamed using 9⅞ inch reamer. The average ROP for the reamer over the same 1400 feet was about 154 feet per hour, almost seven times as fast as the pilot bit despite the fact that the reamer was cutting about 2.3 times the volume of earth as the pilot bit.

One reason the reamer is believed to be able to move so much faster than the pilot bit is because the pilot bit is believed to substantially weaken or "stress relieve" the formation in the area immediately surrounding the pilot hole. That is, when the pilot bit moves through a formation, the rock surrounding the path of the bit is shattered or at least substantially weakened by the passage of the pilot bit. Thus, when the reamer follows the pilot bit, it is able to travel much faster because the cutting is much less difficult.

The operation of drilling systems is expensive. Much of the equipment is rented by the day, and delays can substantially increase the cost of the well. As the previous example illustrates, to separately drill a pilot hole and then ream the bore out to the desired size requires the entire drill string to be removed and the well to be rerun. This can be very time consuming and thus very expensive. Accordingly, a drilling system that meets the following objectives is desired.

OBJECTS OF INVENTION

It is an object of the invention to provide an drilling system that can simultaneously drill a pilot hole and ream the well bore.

It is another object of the invention to provide a drilling system that will prevent damage to the drilling system when the diameter of the well casing is reduced.

It is a further object of the invention to maximize the size of the mud motor that can be used with a given pilot bit.

It is a still further object of the invention to increase the tangential speed of the pilot bit, and particularly the center of the pilot bit, with respect to the formation.

It is yet another object of the invention to maximize the size of the pilot hole formed with a given pilot bit.

It is a still further object of the invention to maximize the rate of penetration of the drill.

It is yet another object of the invention to minimize the cost of drilling a well.

SUMMARY OF INVENTION

The inventor has combined the pilot bit and the reamer in a single unit. A mud motor is contained in the drilling housing. A pilot bit extends from the end of the housing. A reamer, which may be a bi-center bit, is mounted to the housing, preferably between the pilot bit and the mud motor. The mud motor will turn the pilot bit while the reamer will be turned as the drill string is rotated from the surface. In an alternative embodiment, the mud motor may drive the pilot bit and the reamer. In either embodiment, the well bore may be drilled and reamed in a single pass.

By positioning the reamer between the pilot bit and the mud motor, the mud motor will be able to pass through the well bore created by the reamer rather than the smaller bore created by the pilot bit. This will allow a mud motor with a larger outside diameter to be used than would otherwise be possible.

In one preferred embodiment, the pilot bit is offset relative to the center of the end of the drill housing. This will provide for increased tangential speed at the point of impact between the pilot bit and the formation at the point opposite the center of the end of the housing. This should increase ROP as well as increase the size of the pilot hole.

BRIEF DESCRIPTION OF THE DRAWINGS

FIG. 8A is a cut-away end view illustrating one connection between a mud motor, a pilot bit, and a reamer utilizing a wabble gear.

FIG. 8B is a cut-away end view illustrating another connection between a mud motor, a reamer, and a pilot bit utilizing a planetary gear.

FIG. 9A illustrates the orbit of an off center pilot bit with respect to the face of the drilling housing.

DETAILED DESCRIPTION OF THE PREFERRED EMBODIMENT

Figure 1:
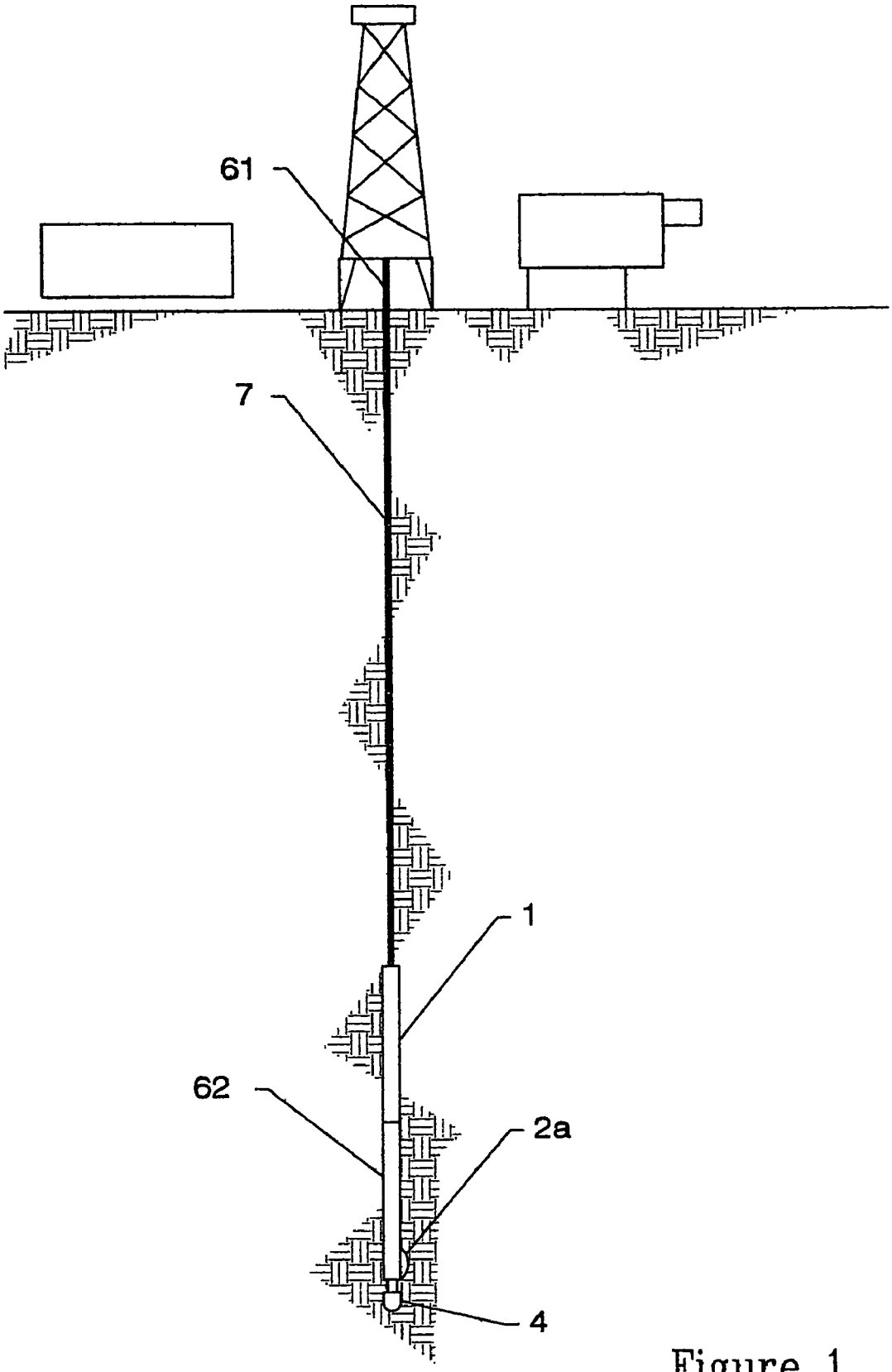
FIG. 1 is a side view of drilling unit in operation.
Figure 2:
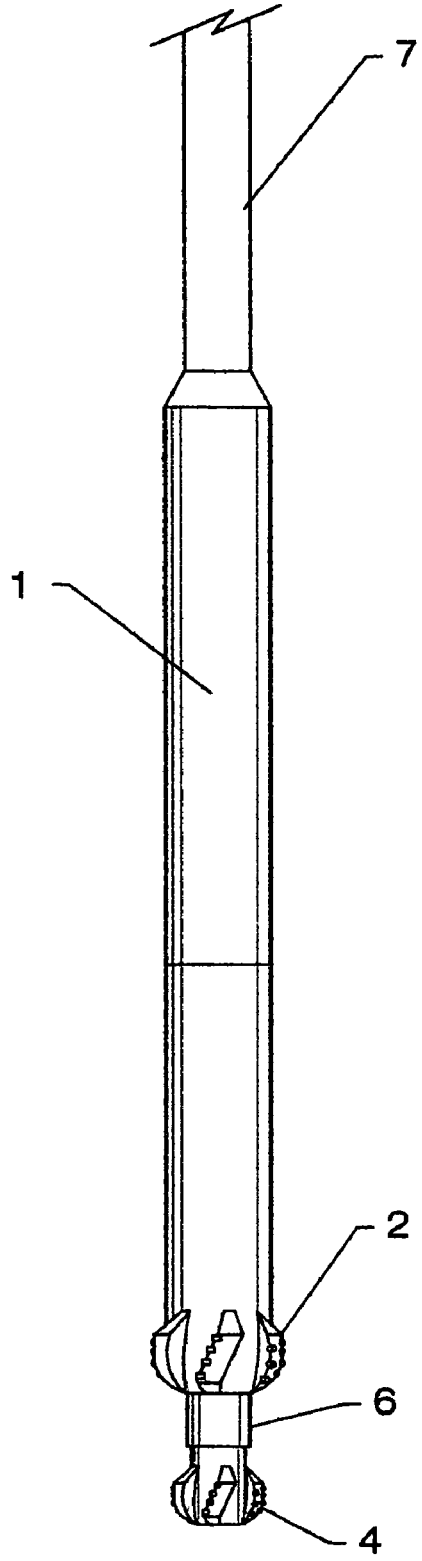
FIG. 2 is a side view of a preferred embodiment of drilling unit having a housing, a pilot bit, and a reamer.
Figure 3:
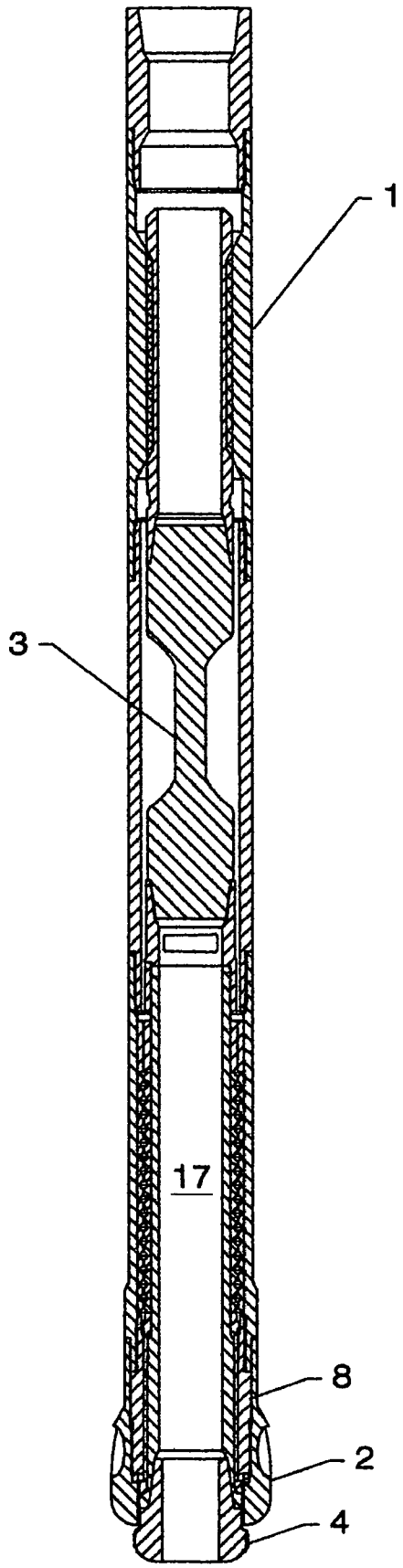
FIG. 3 is a cut-away side view of a preferred embodiment of a drilling housing illustrating the mud motor and its preferred location in relation to the reamer.
Figure 4:
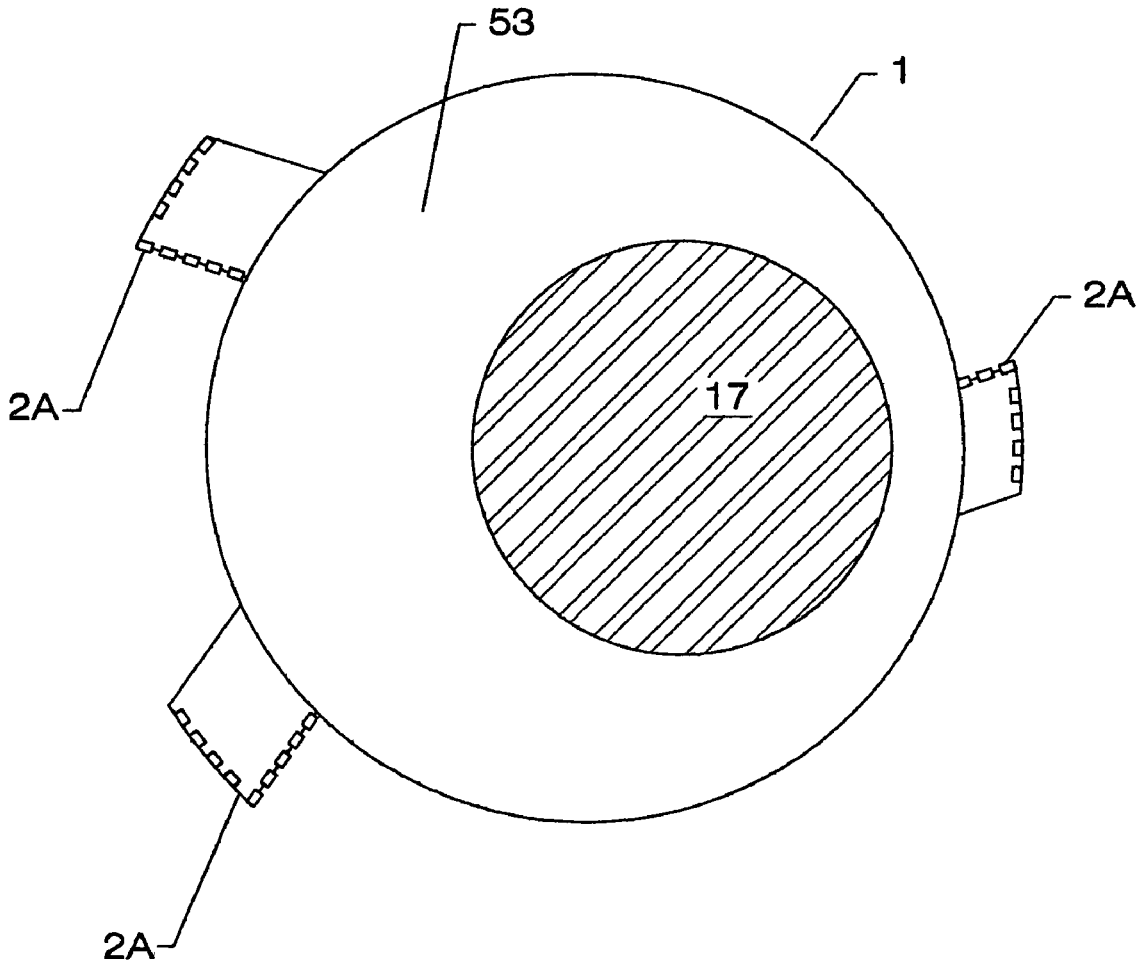
FIG. 4 is a cut away end view of a drilling housing illustrating a bi-center bit.
Figure 5:
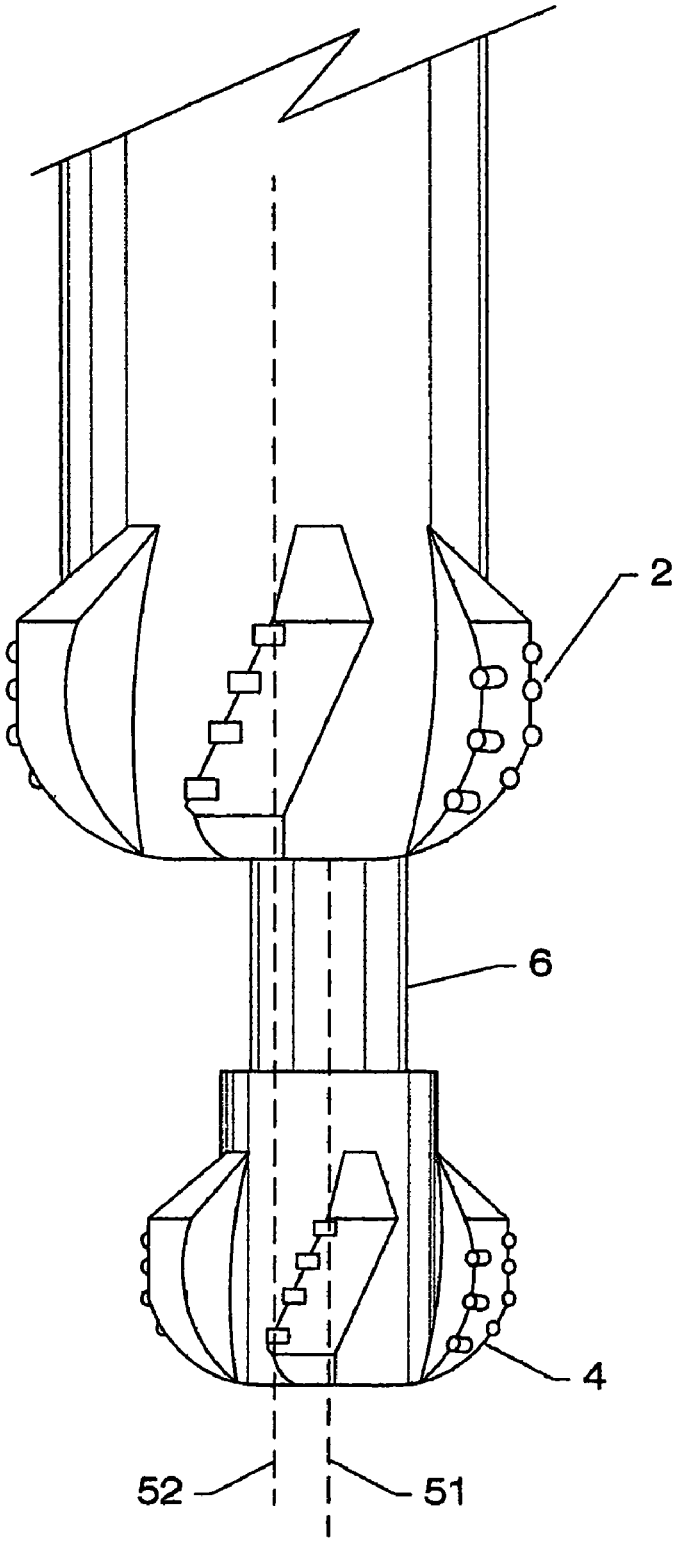
FIG. 5 is a side view of a drilling housing illustrating an off center placement of a pilot bit and mud motor relative to the center of the face of the drilling housing. The degree of offset is shown in exaggerated proportion for illustrative purposes.
Figure 5A:
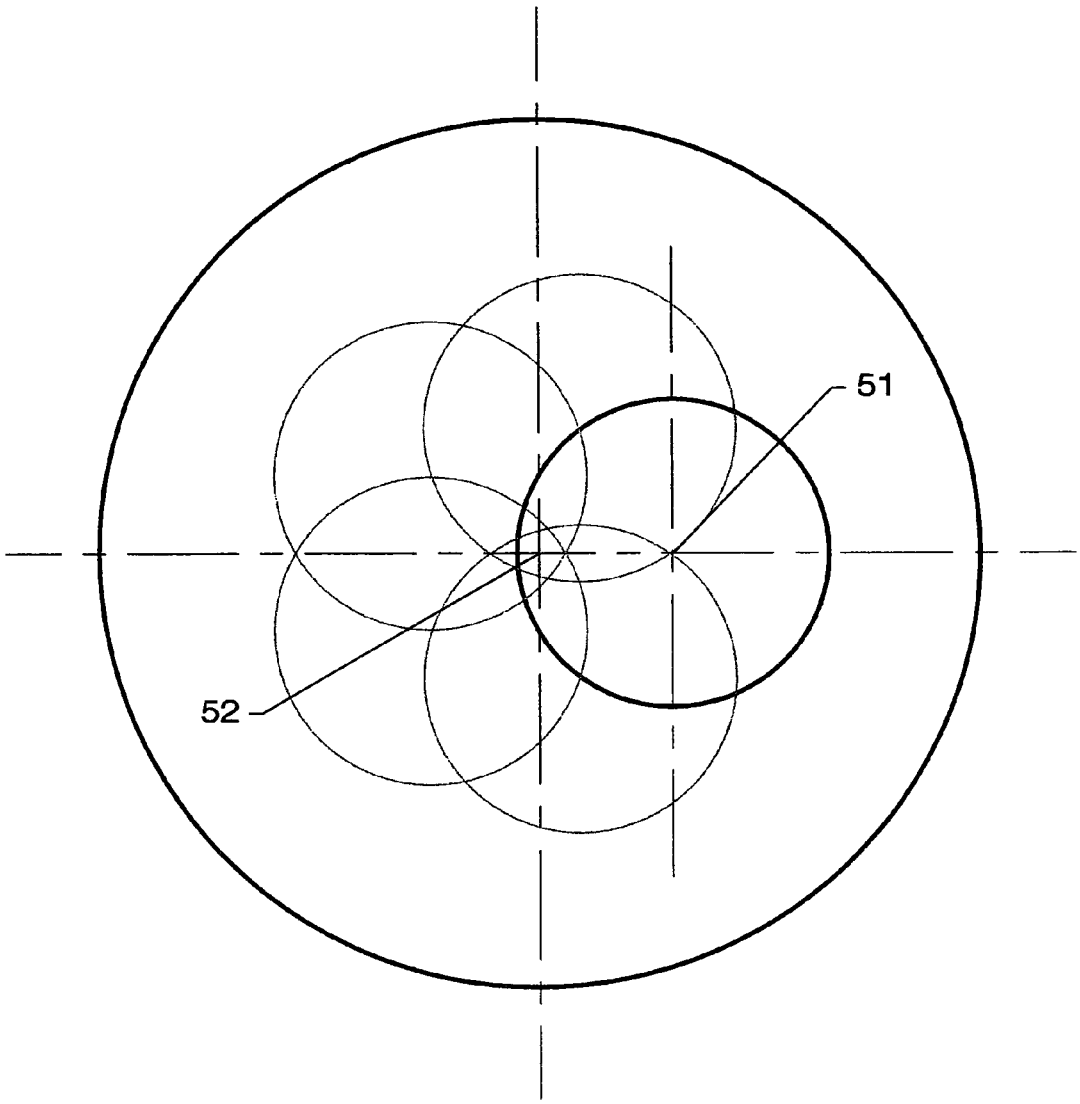
FIG. 5A illustrates the orbit of an off center pilot bit with respect to the reamer core.
Figure 6:
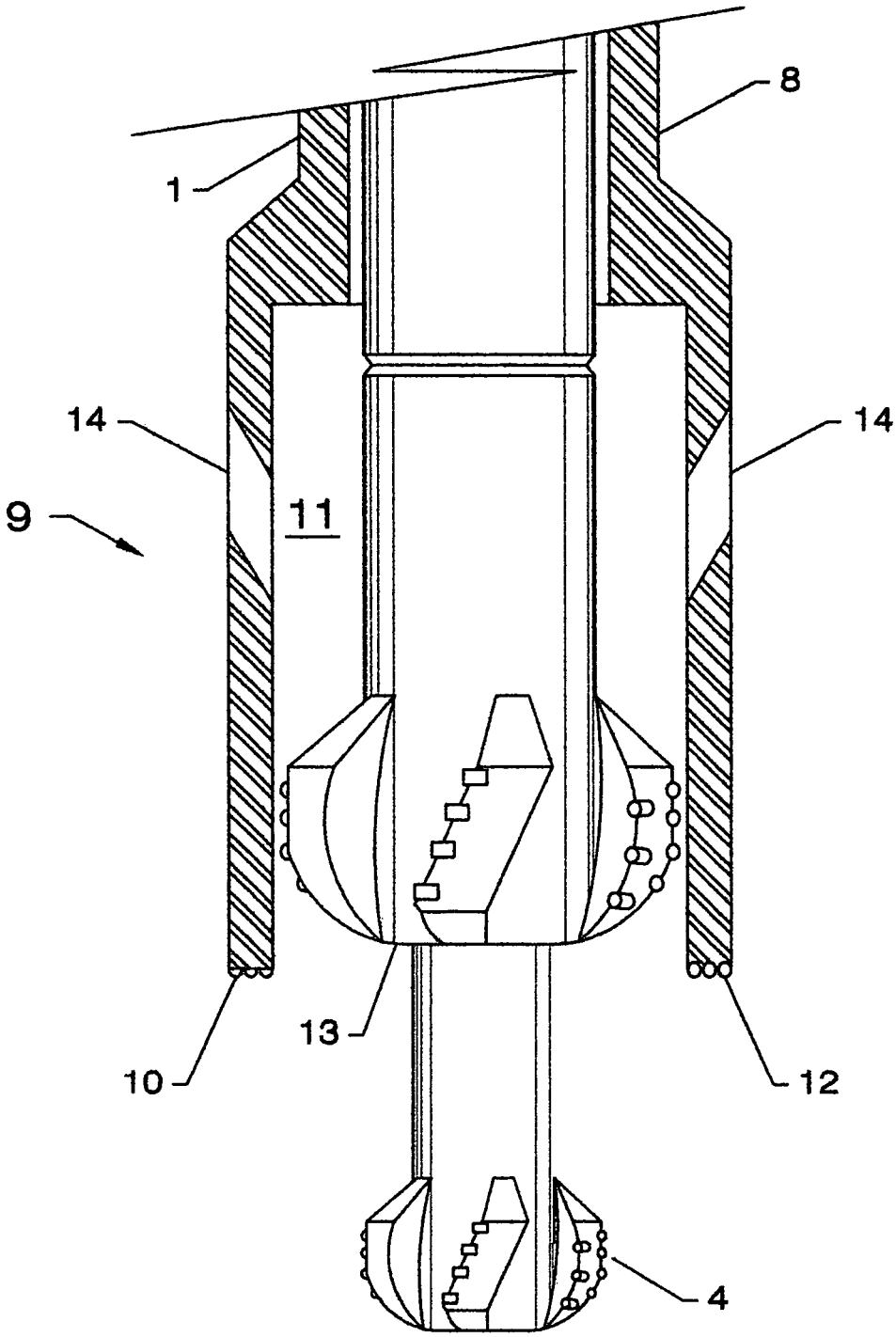
FIG. 6 is a cut away side view of a drilling housing containing a core bit and a pilot bit.
Figure 7:
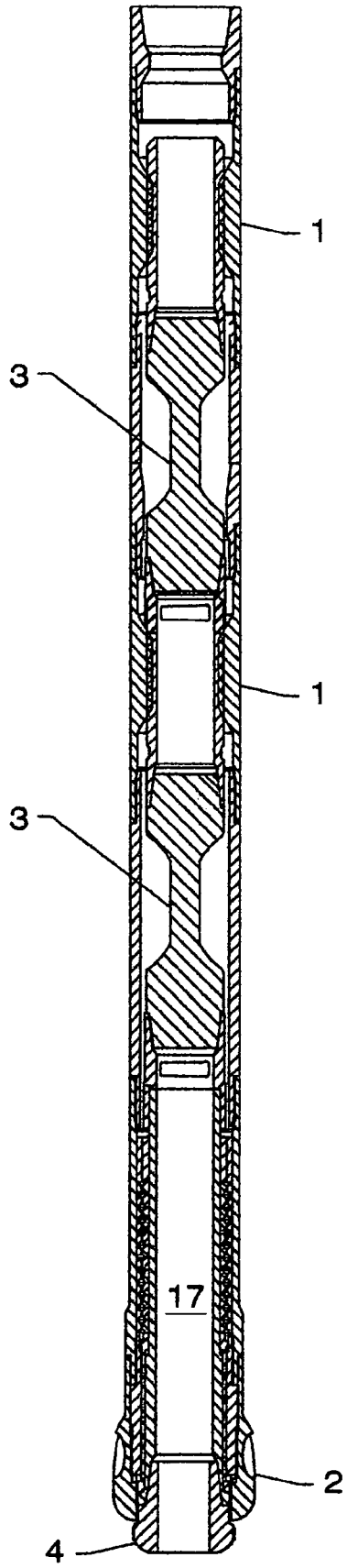
FIG. 7 is a cut away side view of a drilling housing containing a plurality of mud motors in series.
Figure 8:
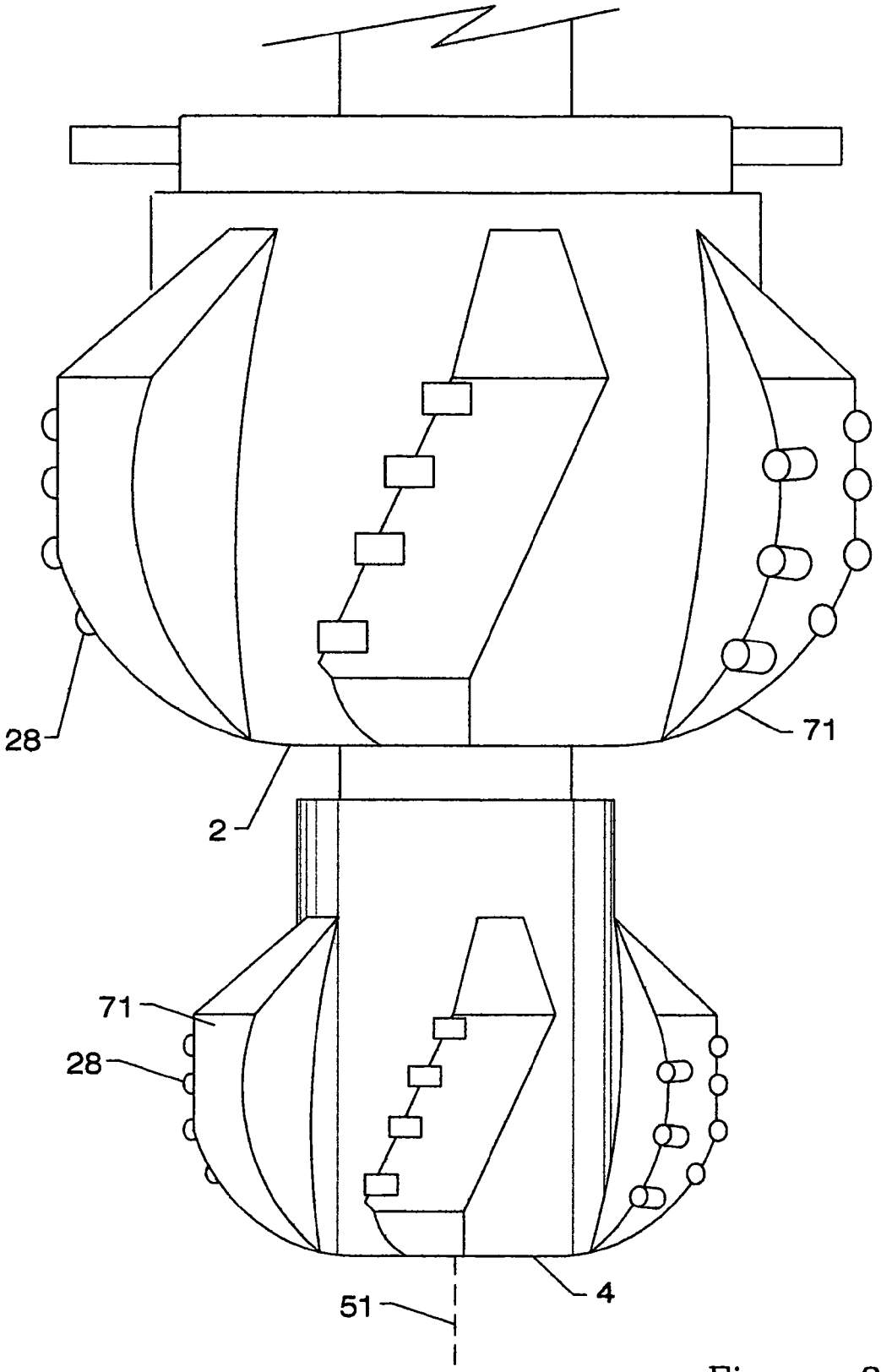
FIG. 8 is a side view of a preferred embodiment of the invention having a reamer and a pilot bit that are each driven by a mud motor.
Figure 9:
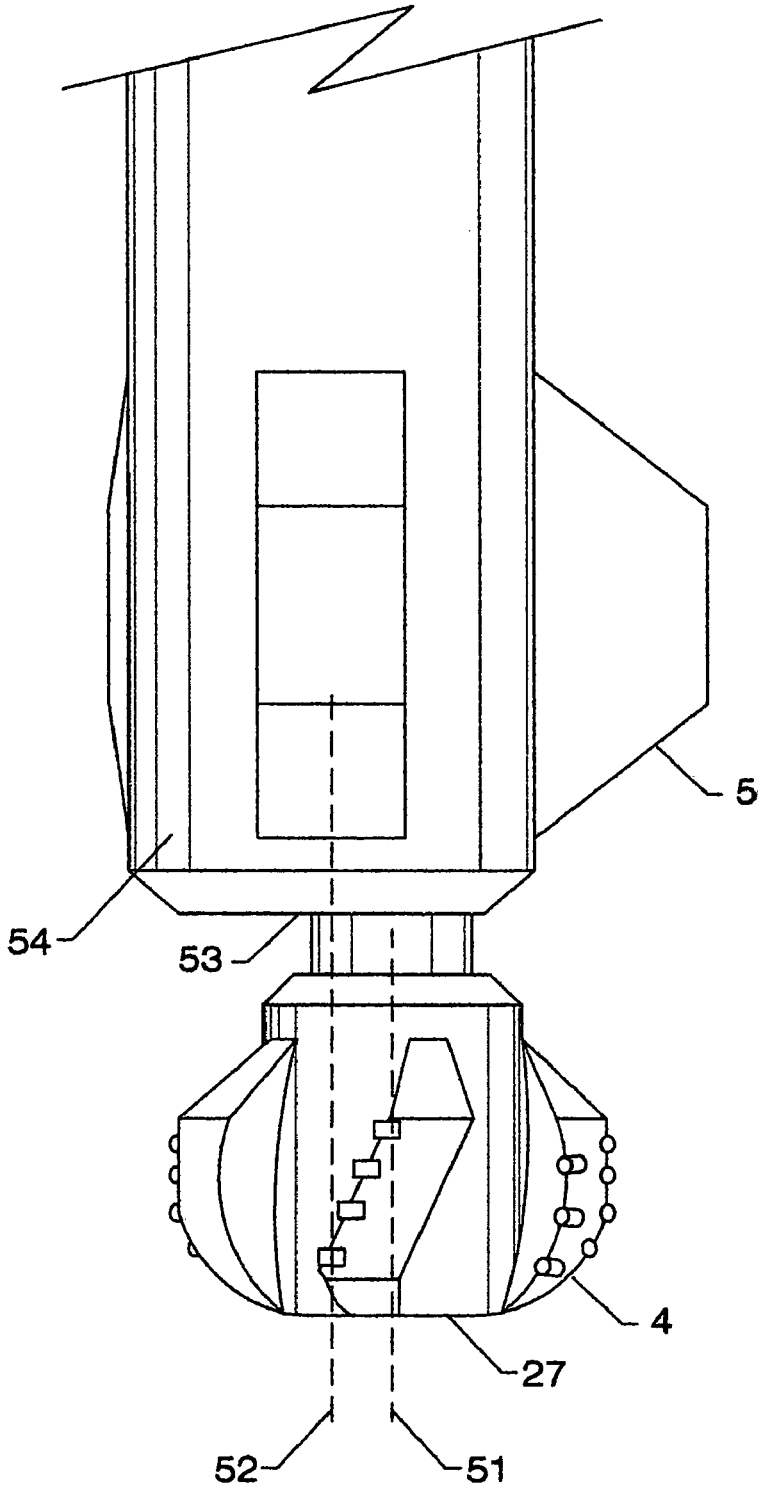
FIG. 9 is a side view of a drilling housing having stabilizers but no reamer and illustrating an off center placement of a pilot bit relative to the center of the face of the drilling housing. The degree of offset is shown in exaggerated proportion for illustrative purposes.

One embodiment of the invention involves the combination of a drill housing 1 having a reamer 2, which may be a bi-center bit 2*a*, with a mud motor 3 and a pilot bit 4. Housing 1 and its attached reamer 2 are located at the bottom end 62 of drill string 7 and may be turned from the surface end 61 of drill string 7. Stabilizers 5 may be placed below and proximate to reamer 2, particularly when bi-center bit 2*a* is used. If reamer 2 were not included, stabilizer 5 would preferably be used in place of reamer 2. A spacing tube may be included between reamer 2 or bi-center bit 2*a* and mud motor 3. Drilling mud flows through the drill string 7 and some exits proximate to reamer 2. This mud lubricates reamer 2 and entrains cuttings. More drilling mud flows through one or more mud motors 3 which in turn drive pilot bit 4.

In the preferred embodiment, mud motor 3 has a 1:2 lobe assembly ratio, but other ratios may be used as desired. The clearance between the rotor and the stator may be adjusted to allow greater or lesser volumes of drilling mud to pass as the circumstances of particular applications dictate. In the preferred embodiment, a passage is provided in the rotor to allow some of the mud to by-pass the mud motor and be discharged in order to lubricate drilling components such as the reamer.

One preferred reamer 2 is a 9⅞ inch outside diameter PDC reamer. The preferred reamer 2 has a seven inch inside diameter and is threaded onto housing 1 just above pilot bit 4. Threading reamer 2 directly onto housing 1 allows the use of sealing surfaces to be avoided.

Substantial torque is transferred from housing 1 to reamer 2. Accordingly, it is preferable to reinforce housing 1 with high strength steel, preferably 125 KSI or higher, and/or to increase the thickness of housing 1 to account for the high torque involved.

Excessive separation between reamer 2 and pilot bit 4 can potentially pose a problem, as explained below. Wells are usually drilled in sections of progressively smaller diameter. When one section is completed, it will be cased in steel pipe and enclosed in concrete. The concrete will be pumped down the casing and back up the outside of the casing, between the casing and the formation, to the surface. The completion of this process will leave the casing surrounded by concrete but empty on the inside except for a concrete cap at the bottom end of the casing which must be drilled though when drilling resumes on the next section of the well bore.

Even when the well bore is "straight," the actual hole will rarely be truly vertical. Thus, the well bore will almost always have a high side and a low side. If there is too much distance between pilot bit 4 and reamer 2, pilot bit 4 will end up off-center and closer to the low side of the well bore. Pilot bit 4 will drill through the concrete cap and begin drilling the formation. However, the hole through the concrete cap will not be centered in the casing. The rest of drill housing 1 will follow through this hole, meaning that the entire drill housing 1 will exit the casing off-center.

This will create a problem as reamer 2 approaches the mouth of the casing. Unlike pilot bit 4, reamer 2 will typically take up most if not all of the casing diameter. If reamer 4 tries to exit the casing off-center, the reamer blades will likely strike the steel walls of the casing. This can obviously lead to damage to reamer 2 and greatly diminish its effective life. Thus, it is preferable to keep the distance between pilot bit 4 and reamer 2 to a minimum, so as to keep pilot bit 4 generally centered below reamer 2. Ideally, this means keeping the distance between reamer 2 and pilot bit 4 less than about thirty-one feet.

In one embodiment that accomplishes this goal, pilot bit 4 is placed immediately below mud motor 3 or with a short extension tube 6 between mud motor 3 and pilot bit 4. Reamer 2 is placed on the outside of housing 1 which contains mud motor 3. Thus, reamer 2 is turned from the surface when drill string 7 is turned, while mud motor 3 drives pilot bit 4. In one embodiment, the inventors contemplate using an extension tube 6 which may be extended and retracted using drilling mud as a hydraulic fluid. In this way, the distance between 2 reamer and pilot bit 4 may be varied as desired.

In another embodiment, housing 1 includes one or more drill collars 8. Mud motor 3 is placed inside a drill collar 8. Reamer 2 is on the outside of drill collar 8 and would preferably be part of drill collar 8. When drill string 7 is rotated from the surface, collar 8 and reamer 2 are turned while mud motor 3 drives pilot bit 4. As before, pilot bit 4 is placed either immediately below mud motor 3 or is separated from mud motor 3 by a short extension tube 6.

The order of mud motor 3, reamer 2 and pilot bit 4 have an effect on the operation of the preferred embodiment. In mud motors, the horsepower generated is a function of the mud motor's outside diameter. All other variables being equal, a mud motor with a larger outside diameter will generate more horsepower than a similar mud motor with a smaller outside diameter. For example, a common 4¾ inch outside diameter mud motor produces about 100 horsepower using six motor stages and a pressure differential—the pressure drop across the motor stages—of 810 pounds per square inch (psi). In contrast, a common 6¾ inch mud motor produces about 200 horsepower using only four stages and requiring a pressure differential of only 520 psi.

While it is generally advantageous to have a larger outside diameter in mud motor 3, the size of mud motor 3 has generally been limited by the outside diameter of pilot bit 4. In most prior art embodiments, the mud motor must be able to pass through the bore created by the pilot bit. Thus, in the prior art the outside diameter of the mud motor must be smaller than the outside diameter of the pilot bit.

In the preferred embodiment, reamer 2 is positioned proximate to pilot bit 4 and mud motor 3 is placed within or above reamer 2. Thus, mud motor 3 must only be able to pass through the bore created by reamer 2 rather than the smaller bore created by pilot bit 4. This is advantageous in that it will allow mud motor 3 to have a larger outside diameter than pilot bit 4. The net result is that the preferred embodiment will allow larger mud motors 3 to be used, thereby delivering more horsepower to pilot bit 4 while using fewer stages and a smaller pressure differential than would have been required otherwise. Ultimately, this will result in a higher ROP from the preferred embodiment.

In another embodiment, reamer 2 comprises a core bit 9. Core bit 9 is generally cylindrical in shape. It has a circular face 10 and a hollow center 11. Circular face 10 is equipped with a bit 12. A pilot bit 4*a* extends from hollow center 11 past circular face 10 of core bit 9. An interior bit 13 is positioned within hollow center 11 of core bit 9. Core bit 9 will be mounted to a housing 1 such as a drill collar 8 that is connected to drill string 7. One or more mud motors 3 will be located inside housing 1. Mud motor or mud motors 3 will drive pilot bit 4 and interior bit 13. Pilot bit 4*a* will create a pilot hole in advance of the rest of core bit 9. When drill string 7 and housing 1 are turned from the surface, circular face 10 will ream the formation. Portions of the formation that wind up inside hollow center 11 will be ground by interior bit 13. Vent openings 14 should be provided in the wall of housing 1 to allow material ground by interior bit 13 to be evacuated from hollow center 11. Drilling mud should be directed to exit the bit proximate to pilot bit 4, circular face 10 and interior bit 13 so that the cutting surfaces may be lubricated and so that the cuttings may be carried away from the cutting surfaces.

The above embodiments of the invention are particularly suited for use with straight drill motor housings which are typically used in drilling straight wells. However, they also may be used with directional motor housings, and especially with those that employ moveable piston pads to provide directional control.

When bent housing directional drilling units are used, the inventors contemplate driving both reamer 2 and pilot bit 4 with one or more mud motors 3.[1] With bent housing directional units, it will often be preferable to have mud motor 3 drive reamer 2 and pilot bit 4. In the preferred embodiment used with bent housings, as with the straight housing embodiments, the inventors contemplate that reamer 2 and pilot bit 4 will be operated at different rates of revolution. By balancing the rotational speed of pilot bit 4 and reamer 2, the efficiency of the drilling operation and the ROP may be maximized. The inventors contemplate that for a pilot bit 4 cutting a bore of about 5½ to about 6 inches in diameter and a reamer 2 cutting a bore of about 8½ to about 9⅞ inches in diameter, the rate of rotation of pilot bit 4 and the rate of rotation of reamer 2 should have a ratio of between about 3:1 and about 4:1 and should most preferably be about 11:3. Thus, for example, if pilot bit 4 is operated at about 500 to about 560 rpm's, reamer 2 should preferably be operated at about 150 rpm's. Particularly where poly-crystalline diamond compact bits are used, ratios of 5:1 and higher between the pilot bit speed and the reamer speed may be desirable.

[1]These embodiments could be used in a straight drilling housing; however, they are expected to be most advantageous when used in combination with a bent housing directional drilling unit.

To achieve the desired relatively high speeds of pilot bit 4 it is preferable to have a high torque mud motor 3 paired with a relatively small diameter pilot bit. For example, when using pilot bits 4 of about 5½ to about 6 inches in diameter, the inventors have found that mud motor torques of about 1360 to about 1650 foot pounds to be sufficient. This is a ratio of torque (in foot pounds) to bit size (in inches) of between about 250:1 and about 275:1. Higher ratios would be expected to provide suitable or even more positive results.

In embodiments where both reamer 2 and pilot bit 4 are powered by mud motor or motors 3, differing rates of rotation can be achieved in several ways. In one embodiment, mud motor or motors 3 drive pilot bit 4 bit directly. In this embodiment, a wabble gear 16 connects the shaft 17 driving pilot bit 4 to the housing 1 on which reamer 2 is mounted. Shaft 17 runs through the portion of housing 1 containing reamer 2. The inside of housing 1 is provided with a gear 18 having teeth 19 facing inwardly toward shaft 17. An eccentric gear 20 is mounted on shaft 17 and in alignment with gear 18 on the interior of housing 1. Because gear 20 on shaft 17 is eccentric, it will engage gear 18 on housing 1 only part of the time—typically once per revolution. When eccentric gear 20 engages gear 18 on housing 1, it will move gear 18 and housing 1 forward slightly and then disengage. Each time eccentric gear 20 makes a revolution, it will move housing 1 and attached reamer 2 slightly further along its own revolution. In this way, shaft 17 turning pilot bit 4 will drive housing 1, but at slower rate of revolution than pilot bit 4. By sizing gear 18 and eccentric gear 20 appropriately, the desired rotational ratio may be achieved.

In another embodiment, mud motor or motors 3 drive the portion of housing 1 containing reamer 2 directly. A planetary gear 21 connects housing 1 to a shaft 17 that drives pilot bit 4. In planetary gear 21, a first gear 22 is positioned on the interior surface 23 of housing 1 with teeth 24 that face shaft 17, which runs through but is not otherwise connected to the portion of housing 1 containing reamer 2. A gear 25, concentric with shaft 17, is positioned on the outside of shaft 17 and in alignment with first gear 22 on interior surface 23 of housing 1. One or more sun gears 26 are positioned between first gear 22 on interior surface 23 of housing 1 and gear 25 on the exterior surface of shaft 17. Thus, as the portion of housing 1 containing reamer 2 is turned by mud motor(s) 3, the rotating portion of housing 1 will turn first gear 22, which turn sun gears 26, which turn shaft gear 25 and shaft 17. By sizing first gear 22, shaft gear 25 and sun gear(s) 26 appropriately, the desired rotational ratio may be achieved.

Of course, where reamer 2 is turned from the surface, a differing rate of rotation between reamer 2 and pilot bit 4 can be obtained simply by rotating drill string 7 at its desired rate and turning pilot bit 4 with mud motor 3 at its desired rate.

In still another embodiment of the invention, mud motors 3, reamers 2, and pilot bit 4 may be applied in series. For example, the series might begin with a 12¼ inch outside diameter reamer 2 which could be driven at rotational speeds of up to 300 rpm's from the surface. A first mud motor 3 would depend from the portion of housing 1 containing first reamer 2. First mud motor 3 would drive a second reamer 2 having an outside diameter of 9 inches at a maximum rotational speed of 1000 rpm's. A second mud motor 3 would depend from the second reamer 2. The second mud motor 3 would drive a 2½ inch outside diameter pilot bit 4 at rotational speeds of up to 1600 rpm's. A third reamer 2 may be positioned between pilot bit 4 and second mud motor 3 in order to allow the outside diameter of each mud motor 3 to be as large as possible. Of course, the sizes of the respective reamers 2 and pilot bits 4 and their respective rotational speeds could change as desired. However, by providing motors 3 in series, extremely high rotational speeds could be obtained from pilot bit 4 while still having the higher torque from the surface equipment available to drive the largest reamer 2.

In most prior art drills, the pilot bit is radially centered at the distal end of the housing. Thus, as the bit rotates, the center of the bit has no tangential speed. In the preferred embodiment, pilot bit 4 is positioned off-center at the end of housing 1, preferably about ⅛ of an inch to about 1½ inches off center. Stated differently, the axis of rotation 51 of pilot bit 4 is not in alignment with the axis of rotation 52 of the face 53 of the distal end 54 of the housing 1. Thus, as drill string 7 is rotated from the surface, the center 27 of pilot bit 4 will be provided with tangential speed relative to the formation at the bottom end of the well bore. This should result in a faster ROP for the drill and a larger pilot hole.

The pilot hole will be larger because pilot bit 4 will orbit around the center of housing 1 as drill string 7 is rotated. When pilot bit 4 is concentric with housing 1, the radius of the pilot hole will be approximately equal to the radius of pilot bit 4. However, when pilot bit 4 is offset from the center of housing 1, the radius of the pilot hole will be equal to the distance from the center of housing 1 to the outside edge of pilot bit 4. Assuming a pilot bit 4 of constant diameter, the offset pilot bit 4 will create a larger diameter pilot hole than the radially centered pilot bit 4. This effect will be even greater in bent housings used in directional drilling.

The simplest way to offset pilot bit 4 from the center of housing 1 will require mud motor 3 to be offset as well, although by appropriately connecting shaft 17 to mud motor 3 with the proper gear arrangement, this does not have to be the case. However, it will be appreciated that when mud motor 3 is offset relative to the center of housing 1, mud motor 3 generally must be smaller in outside diameter than mud motor 3 could have otherwise been were mud motor 3 centrally disposed in housing 1. By positioning mud motor 3 above reamer 2, the total space available for mud motor 3 may be maximized as discussed above. Thus, the placement of mud motor 3 above reamer 2 is particularly useful where other factors, such as an offset position of mud motor 3, limits the diameter of mud motor 3.

Reamer 2 is preferably provided with gage protection 28: PDC or other cutting surfaces on the sides of reamer 2 in addition to those on its face. Although it may be useful in any of the embodiments described herein, gage protection 28 in reamer 2 is expected to be particularly desirable when pilot bit 4 is offset. Pilot bit 4 may or may not have gage protection 28; however, omitting gage protection 28 from pilot bit 4 may enhance the sweeping motion of pilot bit 4 in its eccentric orbit when pilot bit 4 is offset.

Where mud motor 3 directly drives pilot bit 4, mud motor 3 may be offset relative to the center-line of housing 1 as well. In this embodiment, both mud motor 3 and pilot bit 4 will orbit the center of housing 1 as drill string 7 is rotated.

In all embodiments described herein, every cutting surface 71 is preferably a poly-crystalline diamond compact (PDC) bit. Other conventional bit material such as tungsten carbide or steel may be used as well, but the preferred cutting material is poly-crystalline diamond. Use of PDC bits will allow bit revolution speeds to reach 500 to 800 rotations per minute (rpm) and higher. Earlier bit materials typically prevented bit speeds from exceeding 200 rpm.

Although the appropriate bit will vary depending upon drilling conditions and environment, one of the inventors' preferred bits is the M-T49, a 6 inch pilot bit available from Diamond Products International of 15500 International Plaza Drive in Houston, Tex.

In the preferred embodiment, the mud motor has a 1:2 lobe assembly ratio, but other ratios may be used as desired. The clearance between the rotor and the stator may be adjusted to allow greater or lesser volumes of drilling mud to pass as the circumstances of particular applications dictate.

Although the invention has been described above as using hydraulically driven mud motors 3 as the primary downhole power source, it will be appreciated by those in the art that gas or air driven motors could be used if desired.

While the invention has been described in terms of its preferred embodiment, other embodiments will be apparent to those of skill in the art from a review of the foregoing. Those embodiments as well as the preferred embodiments are intended to be encompassed by the scope and spirit of the following claims.

We claim:

1. A drilling system for drilling a sub surface well bore having a surface end and a bottom end comprising:

a drill string configured to extend from said surface end to a housing, said housing having an exterior surface and a distal end, said housing containing a mud motor in fluid communication with said surface via said drill string, whereby said mud motor may be operated with fluid pumped from said surface;

a pilot bit extending from said distal end of said housing, said pilot bit in mechanical communication with said mud motor, whereby operation of said mud motor will power said pilot bit;

and a reamer, comprising a bi-center bit and extending from the exterior surface of said housing, whereby rotation of said housing will rotate said reamer, wherein said reamer is mounted on a rotatable section of said housing, wherein said rotatable section of said housing is connected to said mud motor, whereby said mud motor is configured to rotate said reamer and said pilot bit, and wherein said housing and said reamer are configured to be rotated by rotating said drill string from said surface end of said well bore;

and wherein said pilot bit is configured to rotate at a rate at least about three times the rate of rotation of said reamer.

2. A drilling system according claim 1 wherein said reamer is positioned between said pilot bit and mud motor.

3. A drilling system according to claim 1 wherein said pilot bit is configured to create a pilot hole extending from the bottom end of the well bore to the reamer and wherein said reamer is configured to enlarge the diameter of the well bore above said pilot hole, said mud motor positioned relative to said reamer to remain above said pilot hole as said well bore is drilled.

4. A drilling system according to claim 1 wherein said pilot bit is configured to create a pilot hole extending from the bottom end of the well bore to the reamer and wherein said reamer is configured to enlarge the diameter of the well bore above said pilot hole, said mud motor positioned relative to said reamer to remain above said pilot hole as said well bore is drilled.

5. A drilling system according to claim 1 wherein said pilot bit is positioned proximate to said reamer.

6. A drilling system according to claim 5 wherein said pilot bit is less than about thirty-one feet from said reamer.

7. A drilling system according to claim 1 wherein said distal end of said housing has a face and wherein said face has an axis of rotation about which said face turns and wherein said pilot bit has an axis of rotation about which said pilot bit rotates, wherein said axis of rotation of said face and said axis of rotation of said pilot bit are not in alignment.

8. A drilling system according to claim 1 wherein said reamer comprises a core bit.

9. A drilling system according to claim 1 wherein said mud motor comprises a plurality of mud motors.

10. A drilling system according to claim 9 wherein said plurality of mud motors are provided in series.

11. A drilling system according to claim 1 wherein said pilot bit has cutting surfaces and wherein at least some of said cutting surfaces are coated with poly-crystalline diamond.

12. A drilling system according to claim 1 wherein said reamer has cutting surfaces and wherein at least some of said cutting surfaces are coated with poly-crystalline diamond.

13. A drilling system according to claim 1 further comprising a least one stabilizer operatively attached to said drill string.

14. A drilling system according to claim 1 further comprising a least one stabilizer operatively attached to said housing.

15. A drilling system for drilling a sub surface well bore having a surface end and a bottom end comprising:

a drill string configured to extend from said surface end to a housing, said housing having an exterior surface and a distal end, said housing containing a mud motor in fluid communication with said surface via said drill string, whereby said mud motor may be operated with fluid pumped from said surface;

a pilot bit extending from said distal end of said housing, said pilot bit in mechanical communication with said mud motor, whereby operation of said mud motor will power said pilot bit;

and a reamer, extending from the exterior surface of said housing, whereby rotation of said housing will rotate said reamer, wherein said reamer is mounted on a rotatable section of said housing, and wherein said rotatable section of said housing is connected to said mud motor, whereby said mud motor is configured to rotate said reamer and said pilot bit, and wherein said pilot bit is configured to rotate at a rate at least about three times the rate of rotation of said reamer.

16. A drilling system for drilling a sub surface well bore having a surface end and a bottom end comprising:

a drill string configured to extend from said surface end to a housing, said housing having an exterior surface and a distal end, said distal end having a face and said face having an axis of rotation, said housing containing a mud motor in fluid communication with said surface via said drill string, whereby said mud motor may be operated with fluid pumped from said surface;

a pilot bit extending from said distal end of said housing, said pilot bit in mechanical communication with said mud motor, whereby operation of said mud motor will power said pilot bit, wherein said pilot bit has an axis of rotation about which said pilot bit rotates, and wherein said axis of rotation of said pilot bit is not in alignment with said axis of rotation of said housing face;

and a reamer, extending from the exterior surface of said housing, whereby rotation of said housing will rotate said reamer, wherein said reamer is mounted on a rotatable section of said housing, and wherein said rotatable section of said housing is connected to said mud motor, whereby said mud motor is configured to rotate said reamer and said pilot bit.

17. A drilling system for drilling a sub surface well bore having a surface end and a bottom end comprising:

a drill string configured to extend from said surface end to a housing, said housing having an exterior surface and a distal end, said housing containing a mud motor in fluid communication with said surface via said drill string, whereby said mud motor may be operated with fluid pumped from said surface;

a pilot bit extending from said distal end of said housing, said pilot bit in mechanical communication with said mud motor, whereby operation of said mud motor will power said pilot bit;

and a reamer, comprising a core bit and extending from the exterior surface of said housing, whereby rotation of said housing will rotate said reamer, wherein said reamer is mounted on a rotatable section of said housing, and wherein said rotatable section of said housing is connected to said mud motor, whereby said mud motor is configured to rotate said reamer and said pilot bit.

* * * * *